US005904385A

United States Patent [19]

Linder

[11] Patent Number: 5,904,385

[45] **Date of Patent: *May 18, 1999**

[54] EXTERIOR HANDLE FOR A MOTOR VEHICLE

[75] Inventor: Anton Linder, Neukirchen, Germany

[73] Assignee: Valeo Deutschland GmbH & Co., Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/905,249

[22] Filed: Aug. 1, 1997

[30] Foreign Application Priority Data

Aug. 1, 1996 [DE] Germany ..... 196 30 997

[51] Int. Cl.[6] ..... E05B 3/00

[52] U.S. Cl. ..... 292/336.3; 292/DIG. 2; 292/DIG. 31

[58] Field of Search ..... 292/336.3, 347, 292/DIG. 2, DIG. 31; 16/112, 115, 110 R; 70/208, 210, DIG. 58, 455, 423, 424–428

[56] References Cited

U.S. PATENT DOCUMENTS

| | | | |
|---|---|---|---|
| 311,910 | 2/1885 | Moeller | 292/DIG. 31 |
| 1,168,066 | 1/1916 | Girardot | 292/DIG. 2 |
| 1,558,980 | 10/1925 | Halinka | 292/DIG. 31 |
| 3,074,750 | 1/1963 | Craig | 292/336.3 |
| 4,370,874 | 2/1983 | Munn | 292/DIG. 31 |
| 5,303,971 | 4/1994 | Johnsen | 292/DIG. 2 |
| 5,467,503 | 11/1995 | Nolte | 16/115 |
| 5,560,659 | 10/1996 | Dault | 292/336.3 |
| 5,638,709 | 6/1997 | Clavin | 70/208 |
| 5,700,044 | 12/1997 | Wartian | 292/336.3 |

*Primary Examiner*—Steven Meyers
*Assistant Examiner*—Gary Estremsky
*Attorney, Agent, or Firm*—Morgan & Finnegan, L.L.P.

[57] ABSTRACT

The invention concerns a handle, especially with a lock, for the exterior of a motor vehicle's gate or door, with a housing in which the handle is sunk, and on which the handle is linked swivel-mounted whereby it is possible to grab around the handle by hand, whereby the front surface of the housing is completely or partially covered on the outside by a covering disk which is swivel-mounted or slidable in such a manner relative to said housing, that the covering disk covers up the handle in the disk's closed-position and the covering disk releases the handle in the disk's open-position, and that the handle 3 is acted upon in an external direction by a spring, by which the handle can be pressed from its internal position into its external position protruding outwards.

11 Claims, 1 Drawing Sheet

EXTERIOR HANDLE FOR A MOTOR VEHICLE

BACKGROUND OF THE INVENTION

The invention concerns a handle, especially with a lock, for the exterior of a motor vehicle's gate or door, with a housing in which the handle is sunk, and on which the handle is linked swivel-mounted, whereby it is possible to grab around the handle by hand, and the like.

It is known how to open a motor vehicle's rear gate by a control button and/or by introducing and turning a key in a lock. From European patent specification 0 300 528, it is furthermore known how to cover up the lock of a rear gate with a swiveling disk which must be twisted before the lock's control component is accessible. This known lock does not have a handle which the hand can grab, so that reaching is necessary to lift the rear gate.

BRIEF SUMMARY OF THE INVENTION

The object of the invention is to improve a handle device of the type mentioned earlier, so that, with simple structure and small external dimensions, the handle is hidden when the gate or door is closed, and the handle is easy to grab after swiveling the covering disk, in order to be able to open the gate or door easily.

After the covering disk has been swivelled to the open-position, the handle does not only become visible, but swivels from its internal position into the external position, so that it is particularly easy to grab. If the covering disk is again swivelled into the closed-position, then the covering disk automatically pushes the handle back into its internal position. The external dimensions thereby become particularly small and the structure is of the simplest and robust type.

Here it is proposed that it is preferable for the covering disk to hold the handle in its internal position when the covering disk is in its closed-position. Here, the covering disk can release the handle in the covering disk's open-position, so that the handle swivels into its external position.

It is particularly advantageous if the handle can be moved into its internal position by the covering disk when the covering disk is swivelled into its closed-position. In the closed-position, the covering disk is held especially securely locked into place if the inside of the covering plate has a recess especially in the shape of a pocket, which the handle partially sticks into when the covering disk is in its closed-position.

It is proposed that it is preferable for the covering disk's swivel axis to lie on the housing's rim. Protection against pinching one's finger is attained by constructing a projection on the free end of the handle on its inside, which sticks into an opening or recess of the housing's back side at least when the handle is in the internal position.

It is particularly advantageous if the housing forms a hollow or pocket which is open in front and at least lies in a subregion behind the handle. The handle should also have the shape of a one-armed elongated lever.

It is advantageous for the housing to be circular and the handle to be arranged diametrically along the housing's front side. It is additionally proposed that the circular covering disk have an emblem on the front.

BRIEF DESCRIPTION OF THE DRAWINGS

An example of the invention is illustrated in the drawing and will be described in more detail below. The drawing shows.

DETAILED DESCRIPTION OF THE INVENTION

The handle device has a housing 1, which has circular, flat front surface 2 on its front, wherein an elongated one-armed handle 3 is sunk in such a way that the front surface of the handle 3, in its internal position, aligns with the front surface 2. Furthermore, a lock's lock cylinder 4 is sunk into the front surface in such a way that the lock cylinder's front aligns, in turn, with the front surface 2. The lock cylinder 4 controls the locking of the motor vehicle's door or rear gate in which the handle device is sunk. The handle device is fastened with its front parallel to the metal sheet of the gate or door for this purpose.

Figure 1:
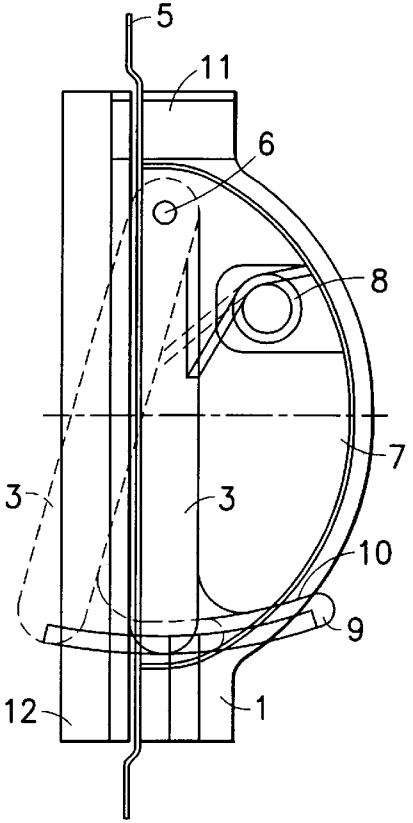
FIG. 1: an axially vertical cross section through the handle device.

The one-armed handle 3 is linked swivel-mounted on an axis 6 at its top end, whereby the elongated handle 3 diametrically crosses the handle's housing, and a hollow or pocket 7, in which a hand can grab, is arranged at least in the lower area of the handle 3 on its back side. In order to be able to grab the handle more easily, the handle 3 is pressed from its internal position into its external position by a helical spring 8 (This procedure is illustrated by dashes in FIG. 1). On the back of the handle 3, on the lower free end, a projection 9, which reaches into or through an opening 10 of the hollow 7 when the handle is in the internal position, is constructed as finger protection. This opening 10 can also operate as a guide for the handle 3.

Figure 2:
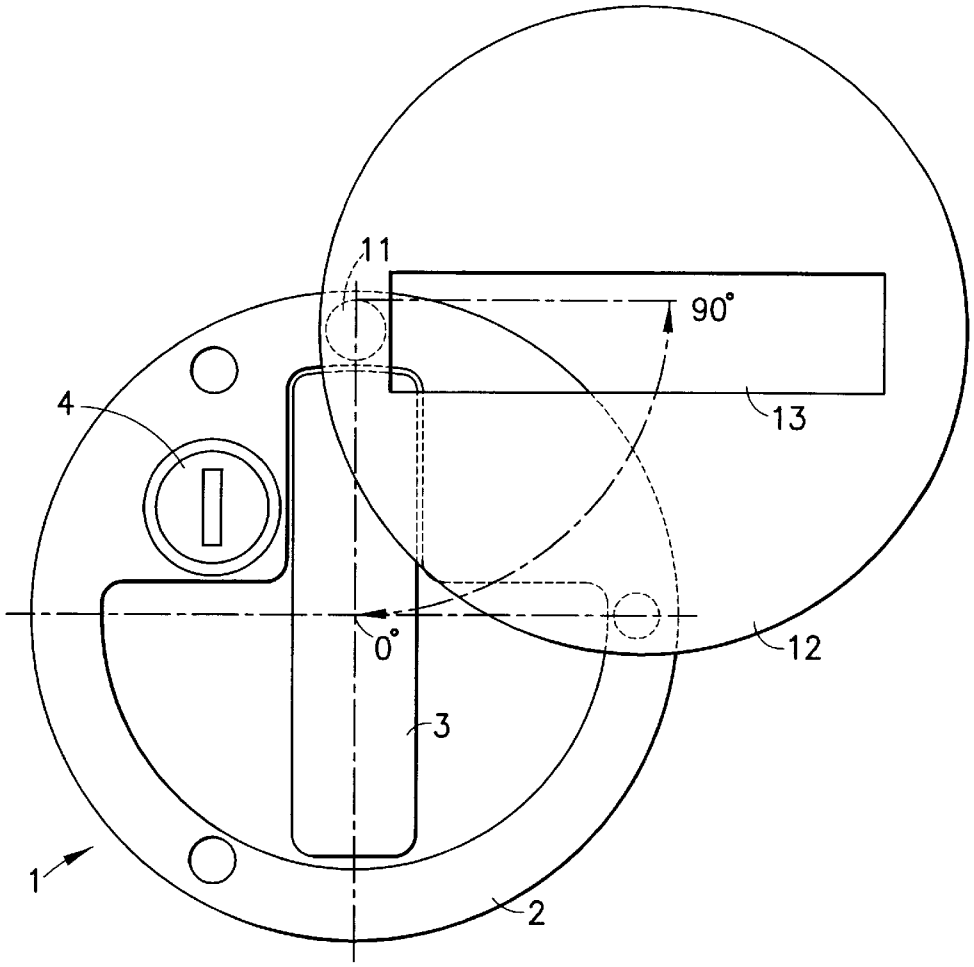
FIG. 2: a front view of the handle device.

A circle shaped covering disk 12 is fitted swivel-mounted around an axis 11. Since the diameter of the disk 12 corresponds to the diameter of the front surface 2, it completely covers the front surface 2 in its closed-position. In its closed-position, the covering disk 12 holds the handle 3 in its internal position. If the covering disk is especially swivelled beyond the open-position illustrated in FIG. 2, then the handle 3 is swivelled and raised outwards around the axis 6 into its external position by the spring 8, so that the handle 3 is easily gripped by hand and the door or gate can easily be opened by the handle 3, without reaching. If the covering disk 12 is turned back into the closed-position after operation, then the disk 12 moves the handle 3 back into its internal position.

A diametrical recess 13, which corresponds approximately to the size and shape of the front of the handle 3, is on the inside of the covering disk 12. In the closed-position of the covering disk 12, the handle 3 penetrates somewhat into this recess 13 due to the pressure of the spring 8, so that the disk 12 is held locked in place by the handle 3 in the disk's closed-position. When the covering disk 12 begins to move from the closed-position into the open-position, the handle 3 is pushed out of the recess 13 against the resistance of the spring 8 for a few millimeters.

It is preferable for the swivel axis 11 of the covering disk 12 to lie on the outer rim of the front surface 2 or housing 1. It therefore lies outside of the hollow or pocket 7. The covering disk 12 can have a decoration on its front, in particular an emblem like that of an automobile manufacturer.

I claim:

1. A motor vehicle handle assembly, comprising a housing located in a mounting surface plane in which a handle is recessed, and on which the handle is pivotally mounted on an axis substantially in said mounting surface plane for movement between an internal position within said housing and a position external thereto, a covering member on said housing, said covering member protruding exterior to said mounting surface plane having an open position relative to said handle and a closed position in which said handle is at least partially covered by said covering member, the covering member being movably mounted on an axis that is substantially perpendicular to the mounting surface plane, such that said covering member is disposed over said handle in said covering member's closed-position and said covering member allows pivotal movement of said handle in said covering member's open-position; and a spring engagable with said handle for biasing said handle against said covering member disposed over said handle in said closed position and to pivot to a projected position, outside of the housing in said covering member's open position.

2. A handle assembly according to claim 1 wherein said covering member bears against and holds said handle in an internal position when said covering member is in its closed-position.

3. A handle assembly according to claim 1 wherein said covering member releases said handle when said covering member is in its open position to disengage said handle biased thereagainst and enable said handle to pivot into its external position.

4. A handle assembly according to claim 1 wherein said handle can be moved into the internal position by said covering member by a swiveling of said covering member into the closed-position to enable said covering member to press against said spring biased handle and pivot said handle into said internal position.

5. A handle assembly according to claim 1 wherein said covering member has a recess for receiving said handle when said covering member is in the closed-position.

6. A handle assembly according to claim 1 wherein said covering member defines a swivel axis running through a rim portion of said housing.

7. A handle assembly according to claim 1 wherein said housing has an opening formed therein, a projection on said handle which projects into said opening in said housing with said handle in said internal position.

8. A handle assembly according to claim 5 wherein said housing forms a pocket having an opening adjoining said covering member to receive said handle therewithin.

9. A handle assembly according to claim 7 wherein said handle has the shape of a one-armed elongated lever.

10. A handle assembly according to claim 1 wherein said housing is circular and said handle is arranged diametrically along said housing's front side.

11. A handle assembly according to claim 1 wherein said covering member is movable laterally with respect to said housing between said open and closed covering positions.

* * * * *